US008924133B2

(12) United States Patent
Hadre et al.

(10) Patent No.: US 8,924,133 B2
(45) Date of Patent: Dec. 30, 2014

(54) TURBOCHARGED ENGINE CANISTER SYSTEM AND DIAGNOSTIC METHOD

(75) Inventors: Christopher G. Hadre, LaSalle, CA (US); Roger C. Sager, Munith, MI (US); Paul J. Gregor, Dexter, MI (US); Richard J. Carnaghi, Macomb, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 383 days.

(21) Appl. No.: 13/406,912

(22) Filed: Feb. 28, 2012

(65) Prior Publication Data

US 2013/0220282 A1 Aug. 29, 2013

(51) Int. Cl.
*F02M 25/08* (2006.01)
*F02D 41/22* (2006.01)

(52) U.S. Cl.
USPC ..... 701/107; 123/520; 123/559.1

(58) Field of Classification Search
CPC ..... F02M 25/0809; F02M 25/0836; F02D 41/22; F02D 41/0032; F02D 41/0037
USPC ..... 123/516, 518, 519, 520, 559.1, 481; 701/103, 107, 112; 73/114.38, 114.39
See application file for complete search history.

(56) References Cited

U.S. PATENT DOCUMENTS

| | | | | |
|---|---|---|---|---|
| 4,530,210 | A * | 7/1985 | Yamazaki | 60/605.1 |
| 5,005,550 | A | 4/1991 | Bugin, Jr. et al. | |
| 5,172,672 | A * | 12/1992 | Harada | 123/520 |
| 5,347,971 | A * | 9/1994 | Kobayashi et al. | 123/520 |
| 6,105,556 | A * | 8/2000 | Takaku et al. | 123/520 |
| 6,305,361 | B1 * | 10/2001 | Takaku et al. | 123/520 |
| 6,327,901 | B1 | 12/2001 | Dawson et al. | |
| 7,347,194 | B2 * | 3/2008 | Sato | 123/520 |
| 7,373,930 | B1 | 5/2008 | Hadre | |
| 7,610,906 | B2 * | 11/2009 | Takakura et al. | 123/520 |
| 8,019,525 | B2 * | 9/2011 | DeBastos et al. | 701/102 |
| 8,056,540 | B2 * | 11/2011 | DeBastos et al. | 123/521 |
| 8,200,411 | B2 * | 6/2012 | DeBastos et al. | 701/102 |
| 8,215,291 | B2 * | 7/2012 | DeBastos et al. | 123/521 |
| 8,447,495 | B2 * | 5/2013 | Pearce et al. | 701/103 |

* cited by examiner

*Primary Examiner* — Hai Huynh
(74) *Attorney, Agent, or Firm* — Ralph E Smith

(57) ABSTRACT

An evaporative emission control system for a turbocharged engine. The system includes a fuel vapor canister in fluid communication with an intake manifold of the engine, a purge valve positioned between the intake manifold and the canister, a bypass valve positioned between the purge valve and the canister and connected to the atmosphere, and an evaporative system integrity monitor operable to seal the canister from the atmosphere when the engine is off. In operation, the monitor is closed so as to seal the canister from the atmosphere, the purge valve is closed so as to isolate the intake manifold from the canister, and the bypass valve is opened so as to connect the canister to the atmosphere. Proper operation of the monitor is determined if the monitor toggles from closed to open when a vacuum in the fuel vapor canister reaches a predetermined level.

9 Claims, 3 Drawing Sheets

TURBOCHARGED ENGINE CANISTER SYSTEM AND DIAGNOSTIC METHOD

FIELD

The present invention generally relates to evaporative emission control systems for automotive vehicles and, more particularly, to a turbocharged engine canister purge system with diagnostic functionality.

BACKGROUND

Modern internal combustion engines generate approximately 20% of their hydrocarbon emissions by evaporative means, and as a result, automobile fuel vapor emissions to the atmosphere are tightly regulated. For the purpose of preventing fuel vapor from escaping to the atmosphere an Evaporative Emissions Control (EVAP) system is typically implemented to store and subsequently dispose of fuel vapor emissions. The EVAP system is designed to collect vapors produced inside an engine's fuel system and send them through an engine's intake manifold into its combustion chamber to get burned as part of the aggregate fuel-air charge. When pressure inside a vehicle's fuel tank reaches a predetermined level as a result of evaporation, the EVAP system transfers the vapors to a charcoal, or purge canister.

Subsequently, when engine operating conditions are conducive, a purge valve located between the intake manifold of the engine and the canister opens and vacuum from the intake manifold draws the vapor to the engine's combustion chamber. Thereafter, the purge canister is regenerated with newly formed fuel vapor, and the cycle continues.

As opposed to vacuum in naturally aspirated applications, at higher throttle levels a turbocharged/supercharged engine's intake manifold can see relatively high boost pressures generated by forced induction. Under this condition, a one-way check valve can be used to prevent backflow through the EVAP system and furthermore a vacuum ejector tee can be used to provide vacuum for purge flow.

In addition to a fuel vapor recovery function, an EVAP system may perform a leak-detection function. To that end, a known analog leak-detection scheme employs an evaporative system integrity monitor (ESIM) switch which stays on if the system is properly sealed, and toggles off when a system leak is detected. When the ESIM switch fails to toggle under specific conditions, an engine control unit (ECU) detects this situation and alerts an operator of the vehicle with a malfunction indicator.

Furthermore, an EVAP system's ability to detect leaks can be regularly verified in engine key-off mode via a so-called rationality test. Presently known rationality tests confirm the ESIM switch functionality through a simulated system leak which is generated by opening the purge valve to relieve a low level of system vacuum (approximately 0.5 KPa) retained from when the engine was running. The ECU then detects if the ESIM toggles from on to off, which is an indicator that the switch is functioning correctly. For the rationality test to be performed in a turbocharged/supercharged engine, however, a leak-detection scheme utilizing an ESIM switch has been heretofore known as requiring a two-way low airflow communication between the purge valve and the intake manifold. A simple check-valve does not permit two-way flow, therefore it will not support both purge flow during boost operation and ESIM functions in an EVAP system of a turbocharged/supercharged engine.

SUMMARY

In one form, the present disclosure provides an evaporative emission control system for a turbocharged engine that may include a fuel vapor canister in fluid communication with an intake manifold of the turbocharged engine, a purge valve positioned between the intake manifold and the fuel vapor canister, a bypass valve positioned between the purge valve and the fuel vapor canister and connected to the atmosphere, and an evaporative system integrity monitor operable to seal the canister from the atmosphere when the engine is off.

In another form, the present disclosure provides a method of testing operation of an evaporative emission control system for a turbocharged engine that may include closing an evaporative system integrity monitor so as to seal a fuel vapor canister from the atmosphere when the engine is turned off, closing a purge valve between an intake manifold and the fuel vapor canister so as to isolate the intake manifold from the fuel vapor canister, opening a bypass valve between the first purge valve and the fuel vapor canister so as to connect the fuel vapor canister to the atmosphere, and determining whether the evaporative system integrity monitor toggles from closed to open when a vacuum in the fuel vapor canister reaches a predetermined level.

In yet another form, the present disclosure provides a non-transitory computer readable medium for testing operation of an evaporative system integrity monitor which, when programmed into a controller of an evaporative emission control system for a turbocharged engine, causes the controller to close a purge valve between an intake manifold and a fuel vapor canister so as to isolate the intake manifold from the fuel vapor canister, open a bypass valve between the purge valve and the fuel vapor canister so as to connect the fuel vapor canister to the atmosphere, and receive a signal indicating whether the evaporative system integrity monitor has toggled from closed to open when a vacuum in the fuel vapor canister reaches a predetermined level.

Further areas of applicability of the present disclosure will become apparent from the detailed description, drawings and claims provided hereinafter. It should be understood that the detailed description, including disclosed embodiments and drawings, are merely exemplary in nature, intended for purposes of illustration only, and are not intended to limit the scope of the invention, its application or use. Thus, variations that do not depart from the gist of the invention are intended to be within the scope of the invention.

DETAILED DESCRIPTION

Figure 1:
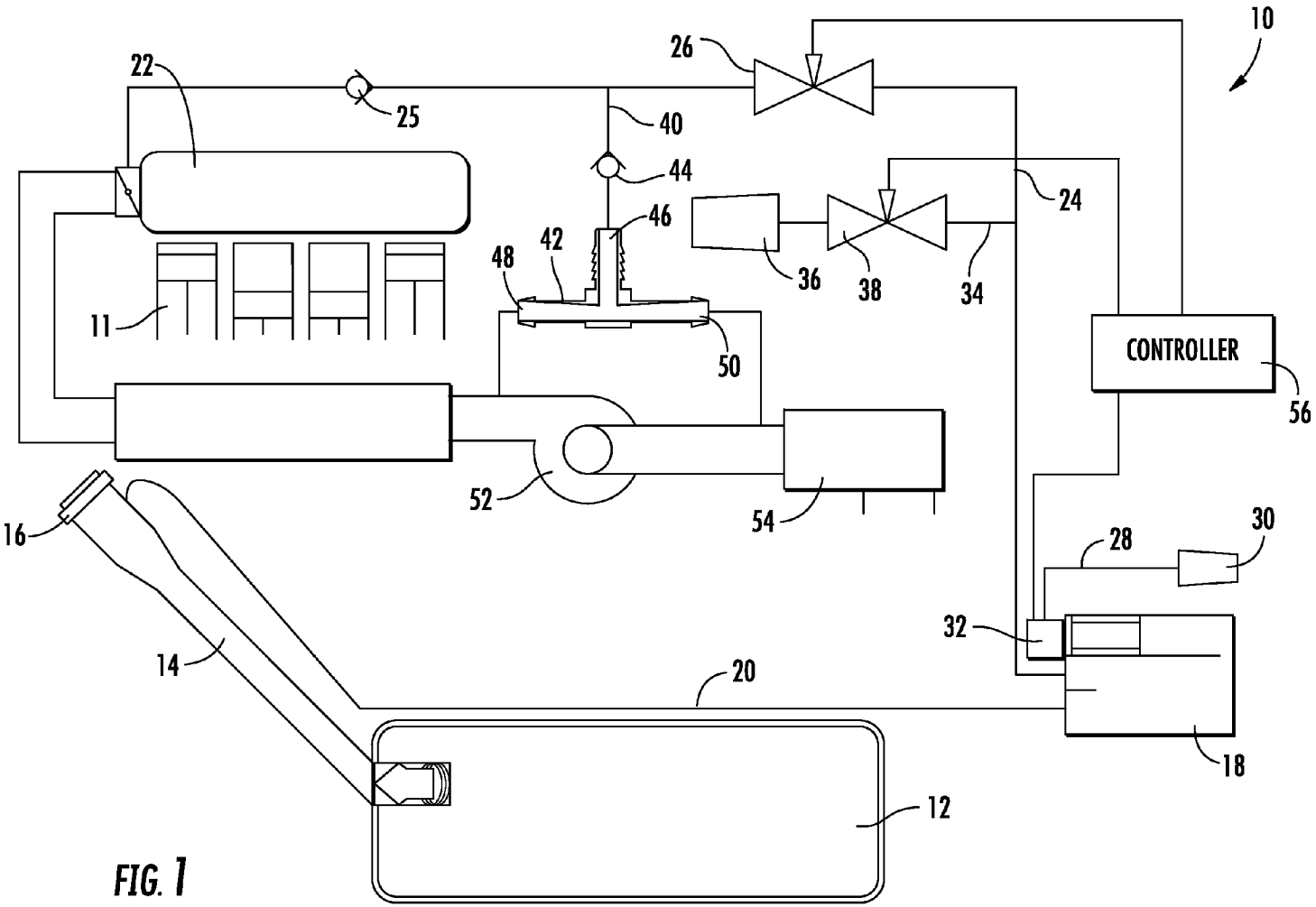
FIG. 1 is a schematic diagram of an evaporative emission control system according to an aspect of the present invention.

Referring now to the drawings in which like elements of the invention are identified with identical reference numerals throughout, FIG. 1 shows an evaporative emission control system 10 of a turbocharged/supercharged engine 11. The evaporative emission control system 10 includes a fuel tank 12 including a fuel fill tube 14 which is sealed by a cap 16. The fuel tank 12 is fluidly coupled to a carbon filled canister 18 by a fuel tank vapor conduit 20. The canister 18 is fluidly coupled to an intake manifold 22 by a canister vapor conduit 24. A solenoid activated purge valve 26 is disposed along the conduit 24 for selectively isolating the canister 18 and fuel tank 12 from the manifold 22. The canister vapor conduit 24 also includes a one-way check valve 25 which prevents fluid (e.g. fuel vapor) backflow from the manifold 22 to the canister 18. A vent line 28 is coupled to the canister 18 and terminates at a filter 30 which communicates with the atmosphere. An evaporative system integrity monitor (ESIM) 32 is disposed between the canister 18 and the filter 30.

The canister vapor conduit 24 is branched at a first location between the purge valve 26 and the canister 18 with a vacuum bypass conduit 34 and terminates at a filter 36 which communicates with the atmosphere. A solenoid activated bypass valve 38 is disposed along canister vacuum bypass conduit 34 for selectively isolating the canister 18 and fuel tank 12 from the filter 36.

The canister vapor conduit 24 is also branched at a second location between the intake manifold 22 and the purge valve 26 with an ejector tee conduit 40. The ejector tee conduit 40 is connected to a vacuum ejector tee 42. The ejector tee conduit 40 also includes a one-way check valve 44 which prevents vapor backflow from the vacuum ejector tee 42 to the manifold 22 and the canister 18.

The vacuum ejector tee 42 includes a first port 46 in fluid connection with ejector tee conduit 40, a second port 48 in fluid connection with an output from a turbocharger/supercharger 52, and a third port 50 in fluid connection with an inlet side of the turbocharger/supercharger 52 an outlet of an air box 54 of the turbocharger/supercharger 52. In an exemplary embodiment, vacuum ejector tee 42 is made from a material that is resistant to a hydrocarbon environment. In an embodiment, it may be made from an engineering plastic.

The evaporative emission control system 10 also includes a controller 56. In an exemplary embodiment, the controller includes software (e.g., non-transitory computer readable medium) for determining whether the engine 11 is off or on, controlling the purge valve 26 and bypass valve 38, reading the state of the vacuum switch of the ESIM 32 indicating whether the ESIM 32 is functioning properly during an engine off condition, and setting a malfunction indicator noting that repair to the ESIM 32 is needed if the ESIM 32 did not toggle from closed to open during the functionality test.

Figure 2:
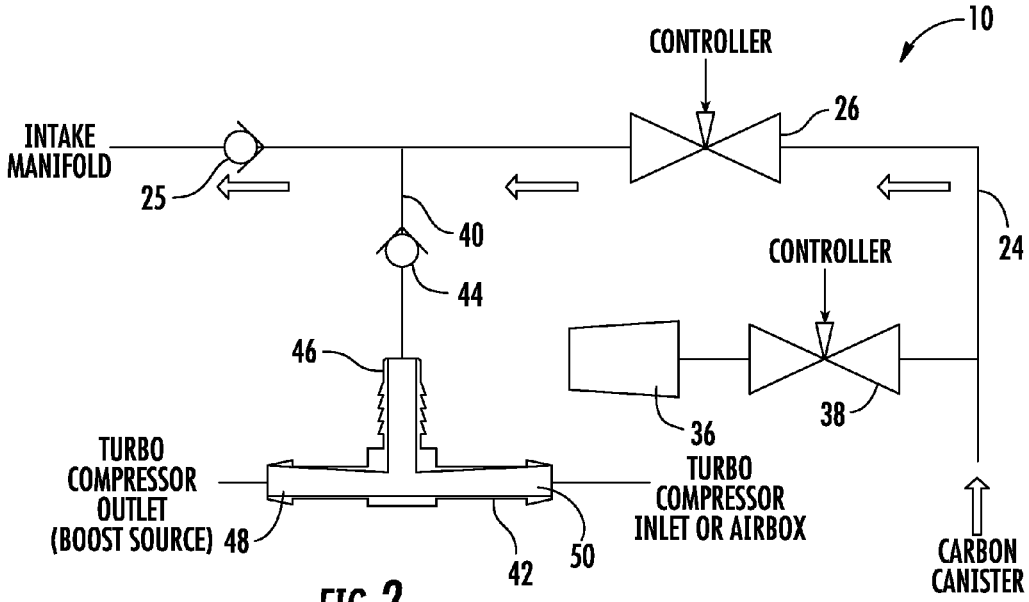
FIG. 2 is a schematic diagram of the evaporative emission control system of FIG. 1 in vacuum purge mode.
Figure 3:
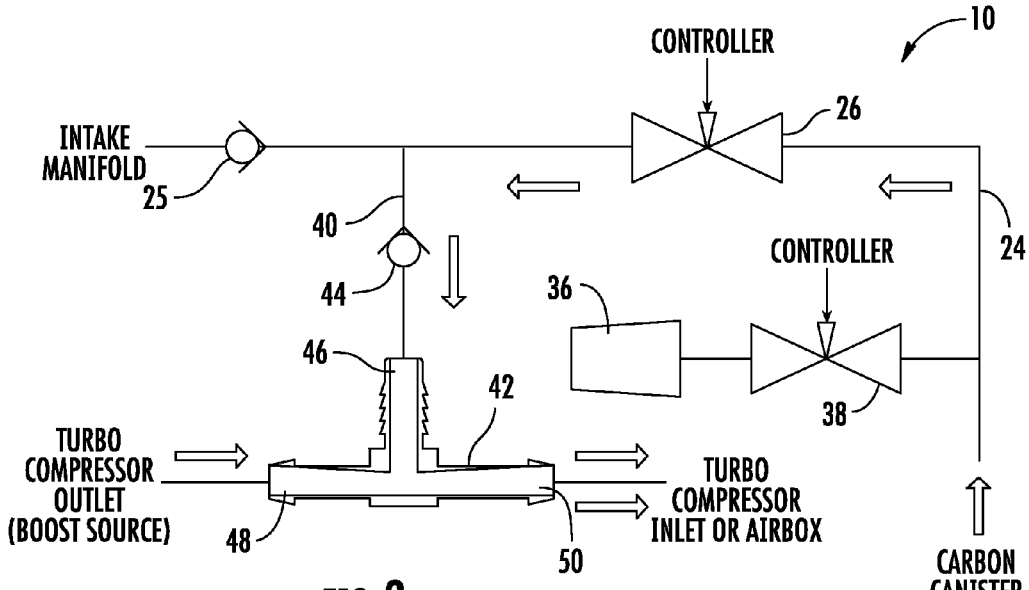
FIG. 3 is a schematic diagram of the evaporative emission control system of FIG. 1 in boost purge mode.
Figure 4:
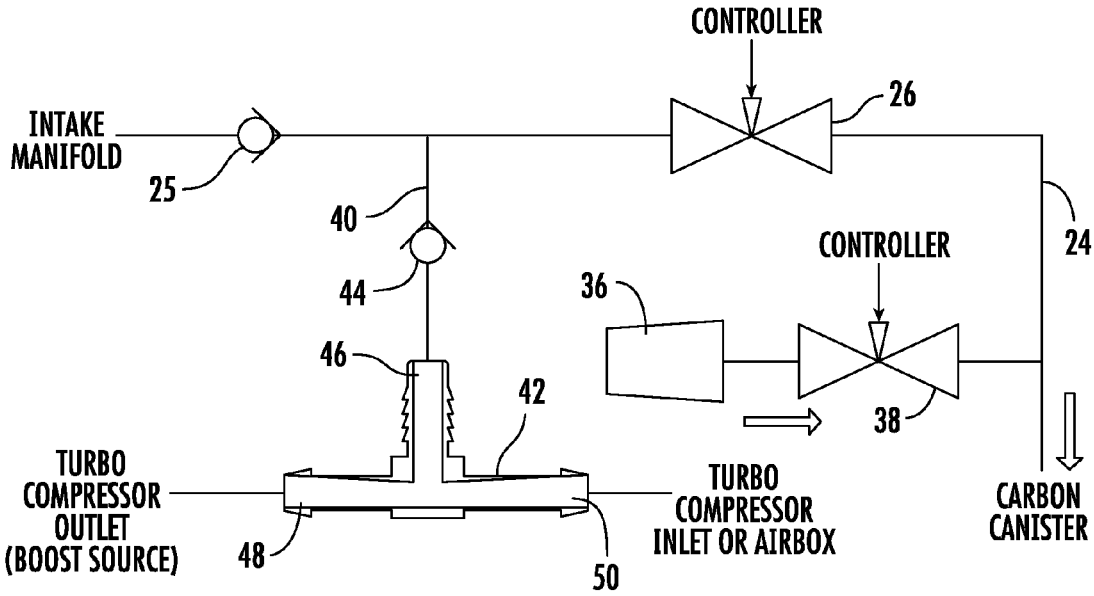
FIG. 4 is a schematic diagram of the evaporative emission control system of FIG. 1 in ESIM switch rationality test mode.

Operation of the system 10 is shown in FIGS. 2-4, which denote the three modes of operation, vacuum purge mode, boost purge mode, and the ESIM test mode, respectively.

In vacuum purge mode shown in FIG. 2, the turbocharger 52 is not operational and a vacuum created in intake manifold 22 by operation of the engine 11 draws vapor from the canister 18 through the vapor conduit 24 for consumption in the engine 11. In vacuum purge mode, the purge valve 26 is open, the vacuum switch in the ESIM 32 is closed, and the bypass valve 38 is closed by the controller 56. This, in turn, causes check valve 44 to be pulled closed thereby preventing air flow from vacuum ejector tee 42. This is the default operating mode of the engine 11 and evaporative emission control system 10.

In boost purge mode shown in FIG. 3, turbocharger 52 is placed in operation, purge valve 26 is open, the vacuum switch in the ESIM 32 is closed, and bypass valve 38 is normally closed. Operation of the turbocharger 52 causes airflow from air box 54 through turbocharger 52 and into manifold 22 creating high pressure to the intake manifold. Check valve 25 closes when exposed to the high pressure, thus preventing backflow. This airflow also causes airflow into port 48 and out of port 50 of vacuum ejector tee 42. This creates a pressure differential in vacuum ejector tee 42 and causes a vacuum to be drawn across port 46 due to a Venturi effect. Due to this vacuum, vapor flows from canister 18 through vapor conduit 24 and into vacuum ejector tee 42 via ejector tee conduit 40. Vapor from canister 18 is then supplied to the inlet of the turbocharger 52 or the air box 54 through port 50 of vacuum ejector tee 42 and routed to the manifold 22 via the turbocharger 52 for consumption by the engine 11.

In ESIM test mode shown in FIG. 4, the engine 11 is not in operation; i.e., in "key-off" condition. In such a "key-off" condition, a vacuum switch in the ESIM 32 is closed by the residual vacuum in the system following an "engine on" event, thus sealing the canister vent line 28. If the evaporative emission control system 10 is free of leaks, the pressure within the system 10 (and within canister 18) will go negative due to either cool down from operating temperatures or during diurnal ambient temperature cycling. When negative pressure is present within system 10, testing of the ESIM 32 functionality is started by the controller 56 by closing purge valve 26 and opening bypass valve 38 as shown in FIG. 4. The opening of bypass valve 38 causes airflow through filter 36 and vacuum bypass conduit 34 into canister 18 to relieve the vacuum within canister 18.

In an exemplary embodiment, the controller 56 is configured to receive a signal indicating whether the vacuum switch of the ESIM 32 toggles from closed to open when the vacuum in the canister reaches a predetermined level after the purge valve 38 is opened. If the signal indicates that the vacuum switch of the ESIM 32 toggled from closed to open, then the controller 56 indicates that the ESIM 32 is functioning properly. If ESIM 32 does not toggle to open, the controller 56 will set a malfunction indicator noting that repair is needed. In an exemplary embodiment, the controller includes a non-transitory computer readable medium for testing operation of the ESIM as discussed herein above.

Thus, an evaporative emission control system 10 according to the invention can effectively provide a diagnostic test of the ESIM in an engine off condition as well as be able to provide canister purge during both vacuum and boost operating modes of the engine 11.

What is claimed is:

1. An evaporative emission control system for a turbocharged engine comprising:

a fuel vapor canister in fluid communication with an intake manifold of the turbocharged engine;

a purge valve positioned between the intake manifold and the fuel vapor canister;

a bypass valve positioned between the purge valve and the fuel vapor canister and connected to the atmosphere;

an evaporative system integrity monitor operable to seal the canister from the atmosphere; and a vacuum ejector tee fluidly coupled between the intake manifold and the purge valve, the vacuum ejector tee having:

a first port in fluid communication with the fuel vapor canister;

a second port in fluid communication with an output of a turbocharger between the turbocharger and the intake manifold; and a third port in fluid communication with an input to the turbocharger.

2. The evaporative emission control system according to claim 1, further comprising a one-way check valve located between the manifold and the purge valve and operable to prevent vapor backflow from the manifold to the canister.

3. The evaporative emission control system according to claim 1, further comprising a one-way check valve located between the first port of the vacuum ejector tee and the purge valve and operable to prevent vapor backflow from the vacuum ejector tee to the manifold and the fuel vapor canister.

4. A method of operating an evaporative emission control system for a turbocharged engine, the method comprising:

in a test mode:

closing an evaporative system integrity monitor so as to seal a fuel vapor canister from the atmosphere when the engine is turned off, the fuel vapor canister being in fluid communication with an intake manifold of the turbocharged engine;

closing a purge valve between the intake manifold and the fuel vapor canister so as to isolate the intake manifold from the fuel vapor canister;

opening a bypass valve between the purge valve and the fuel vapor canister so as to connect the fuel vapor canister to the atmosphere; and determining whether the evaporative system integrity monitor toggles from closed to open when a vacuum in the fuel vapor canister reaches a predetermined level;

in a vacuum purge mode:

closing the evaporative system integrity monitor so as to seal the fuel vapor canister from the atmosphere when the engine is turned on and a turbocharger is not operational;

opening the purge valve between the intake manifold and the fuel vapor canister so as to connect the intake manifold to the fuel vapor canister; and closing the bypass valve between the purge valve and the fuel vapor canister so as to prevent air flow from entering a vacuum ejector tee fluidly coupled between the intake manifold and the purge valve, the vacuum ejector tee having a first port in fluid communication with the fuel vapor canister, a second port in fluid communication with an output of the turbocharger between the turbocharger and the intake manifold, and a third port in fluid communication with an input to the turbocharger;

in a boost purge mode:

closing the evaporative system integrity monitor so as to seal the fuel vapor canister from the atmosphere when the engine is turned on and the turbocharger is operational;

opening the purge valve between the intake manifold and the fuel vapor canister so as to connect the intake manifold to the fuel vapor canister;

closing the bypass valve between the purge valve and the fuel vapor canister so as to cause air flow into the first port of the vacuum ejector tee, air flow out of the third port of the vacuum ejector tee and into the input of the turbocharger, and air flow from the output of the turbocharger into the second port of the vacuum ejector tee.

5. The method of operating an evaporative emission control system according to claim 4, further comprising setting a malfunction indicator noting that repair is needed when the signal indicates that the evaporative system integrity monitor did not toggle from closed to open in the test mode.

6. A non-transitory computer readable medium for operating an evaporative system integrity monitor, which when programmed into a controller of an evaporative emission control system for a turbocharged engine, causes the controller to:

in a test mode:

close a purge valve between an intake manifold and a fuel vapor canister so as to isolate the intake manifold from the fuel vapor canister;

open a bypass valve between the purge valve and the fuel vapor canister so as to connect the fuel vapor canister to the atmosphere; and receive a signal indicating whether the evaporative system integrity monitor has toggled from closed to open when a vacuum in the fuel vapor canister reaches a predetermined level;

in a vacuum purge mode:

close the evaporative system integrity monitor so as to seal the fuel vapor canister from the atmosphere when the engine is turned on and a turbocharger is not operational;

open the purge valve between the intake manifold and the fuel vapor canister so as to connect the intake manifold to the fuel vapor canister; and close the bypass valve between the purge valve and the fuel vapor canister so as to prevent air flow from entering a vacuum ejector tee fluidly coupled between the intake manifold and the purge valve, the vacuum ejector tee having a first port in fluid communication with the fuel vapor canister, a second port in fluid communication with an output of the turbocharger between the turbocharger and the intake manifold, and a third port in fluid communication with an input to the turbocharger; and in a boost purge mode:

close the evaporative system integrity monitor so as to seal the fuel vapor canister from the atmosphere when the engine is turned on and the turbocharger is operational;

open the purge valve between the intake manifold and the fuel vapor canister so as to connect the intake manifold to the fuel vapor canister; and close the bypass valve between the purge valve and the fuel vapor canister so as to cause air flow into the first port of the vacuum ejector tee, air flow out of the third port of the vacuum ejector tee and into the input of the turbocharger, and air flow from the output of the turbocharger into the second port of the vacuum ejector tee.

7. The non-transitory computer readable medium according to claim 6, wherein the controller determines that the evaporative system integrity monitor is functioning properly when the signal indicates that the evaporative system integrity monitor toggled from closed to open in the test mode.

8. The non-transitory computer readable medium according to claim 6, wherein the controller determines that the evaporative system integrity monitor is not functioning properly when the signal indicates that the evaporative system integrity monitor did not toggle from closed to open in the test mode.

9. The non-transitory computer readable medium according to claim 8, wherein the controller sets a malfunction indicator noting that repair is needed when the signal indicates that the evaporative system integrity monitor did not toggle from closed to open in the test mode.

* * * * *